US009074839B2

(12) United States Patent
Warburton

(10) Patent No.: US 9,074,839 B2
(45) Date of Patent: Jul. 7, 2015

(54) INTERCHANGEABLE BUTTSTOCK SYSTEM FOR RIFLES

(71) Applicant: Sturm, Ruger & Company, Inc., Southport, CT (US)

(72) Inventor: Scott Warburton, South Acworth, NH (US)

(73) Assignee: Sturm, Ruger & Company, Inc.

( * ) Notice: Subject to any disclaimer, the term of this patent is extended or adjusted under 35 U.S.C. 154(b) by 0 days.

(21) Appl. No.: 14/152,157

(22) Filed: Jan. 10, 2014

(65) Prior Publication Data

US 2014/0190055 A1 Jul. 10, 2014

Related U.S. Application Data

(60) Provisional application No. 61/750,964, filed on Jan. 10, 2013.

(51) Int. Cl.
*F41C 23/20* (2006.01)
*F41C 23/14* (2006.01)

(52) U.S. Cl.
CPC ..... *F41C 23/20* (2013.01); *F41C 23/14* (2013.01)

(58) Field of Classification Search
CPC ..... F41C 23/00; F41C 23/02; F41C 23/06; F41C 23/08; F41C 23/14; F41C 23/18; F41C 23/20; F41C 23/22; F41A 11/00; F41A 11/02
See application file for complete search history.

(56) References Cited

U.S. PATENT DOCUMENTS

| | | | | | |
|---|---|---|---|---|---|
| 837,601 | A | * | 12/1906 | Behr | 42/74 |
| 2,669,051 | A | * | 2/1954 | Cline | 42/71.01 |
| 3,039,222 | A | * | 6/1962 | Hoge | 42/74 |
| 3,371,442 | A | * | 3/1968 | Carlson | 42/74 |
| 3,830,003 | A | | 8/1974 | Clerke | |
| 4,055,016 | A | * | 10/1977 | Katsenes | 42/71.01 |
| 4,203,244 | A | * | 5/1980 | Hickman | 42/73 |
| 4,316,342 | A | * | 2/1982 | Griggs | 42/74 |
| D267,263 | S | | 12/1982 | Hyytinen | |
| 4,663,877 | A | * | 5/1987 | Bragg | 42/74 |
| 4,769,937 | A | * | 9/1988 | Gregory et al. | 42/74 |
| 4,869,008 | A | | 9/1989 | Rasmussen | |
| 4,896,446 | A | * | 1/1990 | Gregory | 42/73 |
| 5,031,348 | A | * | 7/1991 | Carey | 42/74 |
| 5,149,899 | A | * | 9/1992 | Dabrowski | 42/72 |
| 5,392,553 | A | * | 2/1995 | Carey | 42/73 |

(Continued)

FOREIGN PATENT DOCUMENTS

FR 2791767 10/2000

OTHER PUBLICATIONS

Corresponding International Search Report PCT/US2014/010992 dated May 6, 2014.

*Primary Examiner* — Bret Hayes
*Assistant Examiner* — Derrick Morgan
(74) *Attorney, Agent, or Firm* — The Belles Group, P.C.

(57) ABSTRACT

A modular buttstock system for firearms includes user replaceable and interchangeable buttstock modules. The modules include a comb portion and butt portion which may be provided in a variety of configurations, sizes, and materials. The modules and firearm buttstock each include complementary configured mounting portions and a mounting system designed to provide interchangeable and removable attachment of the modules to the buttstock. In some non-limiting embodiments, the buttstock and modules may be formed of synthetic materials.

43 Claims, 11 Drawing Sheets

(56) References Cited

U.S. PATENT DOCUMENTS

| | | | | |
|---|---|---|---|---|
| 5,711,102 | A * | 1/1998 | Plaster et al. | 42/71.01 |
| 5,864,978 | A * | 2/1999 | McRary et al. | 42/71.01 |
| 5,933,997 | A * | 8/1999 | Barrett | 42/73 |
| 5,970,642 | A | 10/1999 | Martin | |
| 6,293,040 | B1 | 9/2001 | Luth | |
| 6,305,115 | B1 * | 10/2001 | Cook | 42/74 |
| 6,374,528 | B1 | 4/2002 | Davis et al. | |
| 6,688,031 | B2 | 2/2004 | Steele | |
| 7,104,002 | B2 * | 9/2006 | Rotundo | 42/73 |
| 7,124,529 | B1 * | 10/2006 | Havelka, Jr. | 42/74 |
| 7,162,822 | B1 | 1/2007 | Heayn et al. | |
| 7,386,952 | B1 * | 6/2008 | Henretty | 42/71.01 |
| D603,013 | S | 10/2009 | Fitzpatrick et al. | |
| 7,665,240 | B1 | 2/2010 | Bentley | |
| 7,673,413 | B2 | 3/2010 | Bentley | |
| D614,717 | S | 4/2010 | Salva | |
| D614,723 | S | 4/2010 | Bentley | |
| 7,716,864 | B2 | 5/2010 | Skrubis et al. | |
| 7,748,154 | B2 | 7/2010 | Moretti | |
| 7,793,453 | B1 | 9/2010 | Sewell, Jr. et al. | |
| 7,805,873 | B2 | 10/2010 | Bentley | |
| 7,814,695 | B1 | 10/2010 | Keeney et al. | |
| D626,618 | S | 11/2010 | Peterson et al. | |
| 7,823,315 | B2 | 11/2010 | Webber et al. | |
| D629,062 | S | 12/2010 | Peterson et al. | |
| 7,886,473 | B2 | 2/2011 | Rotharmel | |
| D636,834 | S | 4/2011 | Mayberry et al. | |
| D637,681 | S | 5/2011 | Bentley et al. | |
| D642,228 | S | 7/2011 | Torre et al. | |
| 7,984,580 | B1 | 7/2011 | Giauque et al. | |
| D645,533 | S | 9/2011 | Peterson et al. | |
| 8,028,458 | B2 | 10/2011 | Rohrauer | |
| 8,176,668 | B2 * | 5/2012 | Simms et al. | 42/1.06 |
| 2002/0005005 | A1 * | 1/2002 | Miller | 42/75.02 |
| 2003/0154640 | A1 * | 8/2003 | Bragg | 42/74 |
| 2003/0182837 | A1 * | 10/2003 | Burigana | 42/74 |
| 2004/0211104 | A1 | 10/2004 | Eberle | |
| 2005/0108915 | A1 | 5/2005 | Kincel | |
| 2005/0235546 | A1 * | 10/2005 | Wonisch et al. | 42/75.01 |
| 2005/0241205 | A1 * | 11/2005 | Rotundo | 42/71.01 |
| 2007/0089347 | A1 | 4/2007 | Webber et al. | |
| 2007/0113459 | A1 | 5/2007 | Stout et al. | |
| 2008/0190005 | A1 | 8/2008 | Rohrauer | |
| 2008/0236016 | A1 | 10/2008 | Fitzpatrick et al. | |
| 2009/0019755 | A1 | 1/2009 | Moretti | |
| 2010/0212204 | A1 * | 8/2010 | Koyama | 42/73 |
| 2011/0302817 | A1 * | 12/2011 | deBrun et al. | 42/74 |
| 2014/0109453 | A1 * | 4/2014 | Paquette | 42/73 |

* cited by examiner

INTERCHANGEABLE BUTTSTOCK SYSTEM FOR RIFLES

CROSS-REFERENCE TO RELATED APPLICATIONS

The present application claims the benefit of U.S. Provisional Patent Application Ser. No. 61/750,964 filed Jan. 10, 2013, which is incorporated herein by reference in its entirety.

BACKGROUND OF THE DISCLOSURE

The present disclosure generally relates to firearms, and more particularly to a highly configurable and customizable buttstock system for long guns including rifles and shotguns.

The gunstock or stock generally forms the part of a rifle or shotgun that a user holds and cradles when carrying, aiming, and discharging the firearm. The barrel, receiver, trigger-actuated firing mechanism, and other appurtenances are typically mounted to and supported by the stock. Types of stocks include one-piece stocks having a continuous unitary structure from the front portion or "fore-end" (also "forearm") to the rear portion or "butt" (also "buttstock"), and two-piece stocks in which the fore-end and butt are comprised of separate components such as in break-open shotguns or some rifles.

Proper sizing and configuration of the buttstock are ergonomically important to some users for comfort, and can affect aiming and accuracy in shooting the firearm. When aiming a rifle or shotgun, the user's cheek will generally rest on or be placed near a top portion or "comb" of the buttstock. Other portions of the buttstock including the rear end or "butt" will be cradled against the user's shoulder and/or chest. User's have physical differences (e.g. stature, weight, etc.) and individual preferences for desired configuration and fit of the buttstock. Many buttstocks, however, are fixed in size and not configurable to a user's needs.

A configurable buttstock system is desired.

SUMMARY OF THE DISCLOSURE

A configurable modular buttstock system according to embodiments of the present disclosure includes user replaceable and interchangeable buttstock modules. The modules include a comb portion and butt portion which may be provided in a variety of configurations, heights, lengths, surface textures/finishes, colors, ornamentation, and materials to suit the needs, preferences, and comfort of a user. The modules and buttstock each include common complementary configured mounting portions and a mounting system designed to provide removable attachment of the modules to the buttstock.

In some embodiments, the buttstock and/or modules preferably may be formed of synthetic materials such as unreinforced or reinforced polymers, composite materials such as fiberglass, graphite, Kevlar, etc., and others materials. In one embodiment, the buttstock and/or modules are formed of a polymer by injection molding.

According to one embodiment, a modular buttstock system for a firearm includes a longitudinally-extending buttstock including a right sidewall, a left sidewall, a closed bottom connecting the right and left sidewalls, a front end, a rear end, and an internal rearwardly open cavity extending between the front and rear ends, and a buttstock module removably attached to the buttstock, the module including a longitudinally-extending upper comb portion positioned above the buttstock and a rear butt portion positioned at the rear end of the buttstock. The buttstock module further includes a forwardly projecting rear mounting flange inserted into the rearwardly open cavity of the buttstock. A fastening mechanism removably secures the buttstock module to the buttstock. The fastening mechanism may be a threaded fastener in some embodiments.

According to another embodiment, a modular buttstock system for a firearm, includes a longitudinally-extending buttstock including a front end having a rearwardly open socket, a rear end, and an upwardly open channel extending between the front and rear ends, and a buttstock module removably attached to the buttstock, the module including a longitudinally-extending upper comb portion positioned above the buttstock and a rear butt portion positioned at the rear end of the buttstock. The buttstock module further includes a downwardly projecting longitudinally-extending side mounting flange inserted into the open channel and a forwardly projecting front mounting flange inserted into the socket. The buttstock module encloses the buttstock when mounted on the firearm.

According to another embodiment, a modular buttstock system for a firearm includes a longitudinally-extending buttstock including a front end having rearwardly open socket and an open rear end, and a buttstock module removably attached to the buttstock, the buttstock module including a longitudinally extending upper comb portion positioned above the buttstock and a rear butt portion positioned at the rear end of the buttstock. The buttstock module further includes a forwardly projecting rear mounting flange inserted into the open rear end of the buttstock and a forwardly projecting front mounting flange inserted into the socket. The buttstock module encloses the buttstock when mounted on the firearm.

According to another embodiment, a modular buttstock system for a firearm includes a longitudinally-extending buttstock including a front end having rearwardly open socket, an open rear end, and an upwardly open channel extending between the front and rear ends, and a buttstock module removably attached to the buttstock, the buttstock module including a longitudinally extending upper comb portion positioned above the buttstock and a rear butt portion positioned at the rear end of the buttstock. The buttstock module further includes a forwardly projecting rear mounting flange inserted into the open rear end of the buttstock, a downwardly projecting side mounting flange inserted into the open channel, and a forwardly projecting front mounting flange inserted into the socket. The buttstock module encloses the buttstock when mounted on the firearm.

A method for assembling a buttstock module to a buttstock of a firearm is provided. The method includes: providing a longitudinally-extending buttstock including a front end and an open rear end; providing a buttstock module including a longitudinally-extending upper comb portion and a downwardly extending rear butt portion; and axially inserting a forwardly projecting rear mounting flange on the buttstock module into the open rear end of the buttstock; wherein the comb portion of the buttstock is positioned above the buttstock and the rear portion of the buttstock module is positioned at the rear end of the buttstock. The method may further include inserting a pair of downwardly projecting longitudinal side mounting flanges into an upwardly open channel formed in a top of the buttstock.

BRIEF DESCRIPTION OF THE DRAWINGS

The features of the exemplary embodiments will be described with reference to the following drawings where like elements are labeled similarly, and in which.

Figure 1:
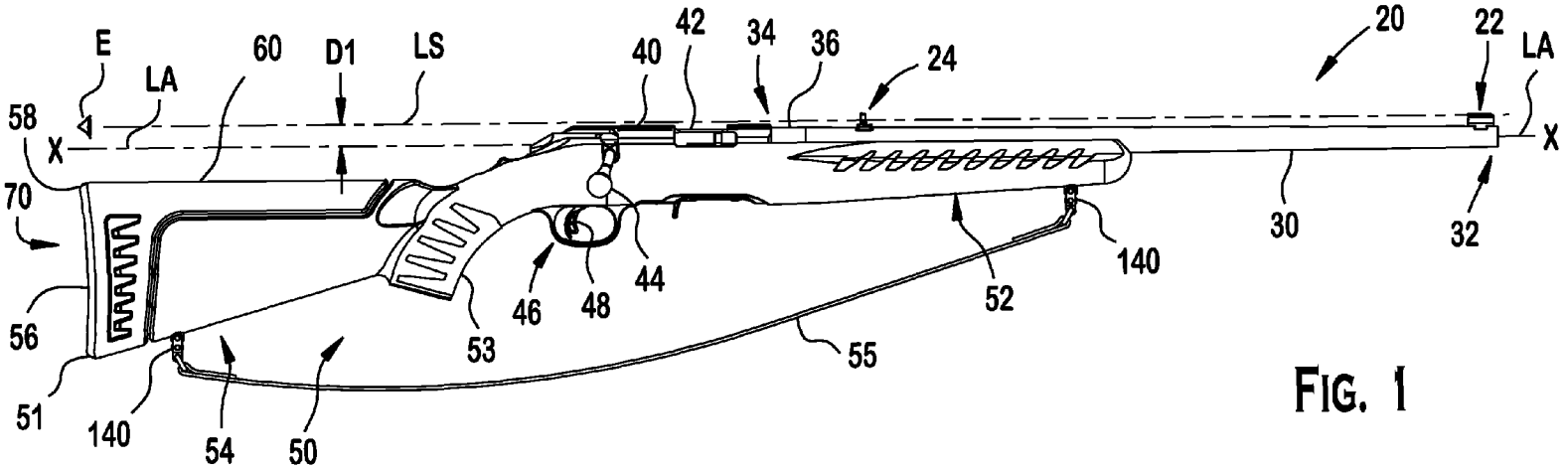
FIG. 1 is a side elevation view of a rifle having a buttstock with an interchangeable buttstock module according to one embodiment of the present disclosure.

All drawings are schematic and not necessarily to scale.

DESCRIPTION OF EXEMPLARY EMBODIMENTS

The features and benefits of the invention are illustrated and described herein by reference to exemplary embodiments. This description of exemplary embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Accordingly, the disclosure expressly should not be limited to such exemplary embodiments illustrating some possible non-limiting combination of features that may exist alone or in other combinations of features.

Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," and "interconnected," refer to a relationship wherein structures are secured or attached to one another either directly or indirectly through intervening structures, as well as both movable or rigid attachments or relationships, unless expressly described otherwise.

An exemplary and non-limiting embodiment of a configurable buttstock system including a plurality of interchangeable buttstock modules according to the present disclosure will now be described with initial reference to FIGS. 1 and 2.

FIG. 1 depicts a firearm in the form of a rifle 20 including a barrel 30 defining a longitudinal axis LA and having a front muzzle end 32 and an opposite rear breech end 34 defining a chamber 36 configured for holding a cartridge. Rifle 20 further includes a receiver 40 having an action with an axially movable breech bolt 42 which engages rear breech end 34 of barrel 30 for forming a closed breech for discharging the rifle and an open breech for extracting/ejecting spent cartridge casings and loading new cartridges into the chamber 36. Rifle 20 further includes a trigger-actuated firing control mechanism 46 operable for retracting and releasing a firing pin or striker to strike a chambered cartridge and discharge the rifle. The rifle 20 shown is a bolt-action rifle having an action with a manually retractable breech bolt 42 operated via bolt handle 44. Actions and firing control mechanisms for firearms and their components are well known to those skilled in the art without further elaboration.

Although the buttstock module system is being described in the present non-limiting embodiment with respect to a rifle, the buttstock module system may be used with any long gun including shotguns. Accordingly, the invention is not necessarily limited to any particular configuration of firearm in its applicability and benefits.

With continuing reference to FIG. 1, rifle 20 includes a gunstock or stock 50 including a forward fore-end 52 and a rearward opposing buttstock 54. Buttstock 54 defines a rear facing butt 56 at a rear end 180 of the buttstock, a heel 58 at a top thereof, and a toe 51 at a bottom thereof. Buttstock 54 further includes a cheek 60 extending axially and longitudinally along a top portion of the buttstock from heel 58 of butt 56 for a distance forward towards the fore-end 52 and muzzle end 22 of rifle 20. Stock 50 further defines a grip 53 disposed forward of toe 51 and rearward of trigger 48. Grip 53 may have any suitable and desirable configuration including straight grip stocks, full grip stocks, semi-grip stocks, and enumerable other variations as are all well known to those skilled in the art.

Figure 2:
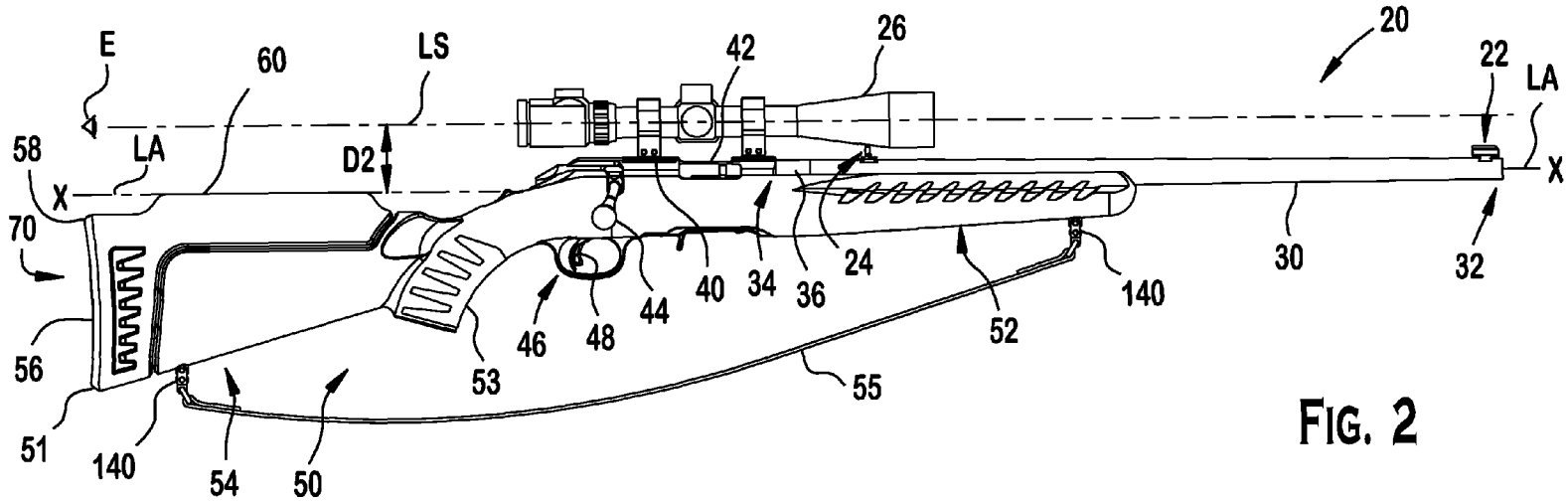
FIG. 2 is a side elevation view thereof showing the buttstock module having a different configuration.

It will be noted that stock 50 shown in FIGS. 1 and 2 is a one-piece stock in which the fore-end 52 and buttstock 54 are formed of a single monolithic piece of material. In other embodiments, stock 50 may be a two-piece stock comprised of a separate fore-end 52 and buttstock 54 such as in the case of a break-open rifle or shotgun. Accordingly, the applicability and use of the interchangeable buttstock system and kit disclosed herein are not limited to any particular style of stock 50.

Stock 50 may be formed of any suitable material including without limitation synthetic materials such as unreinforced or reinforced polymers, composite materials such as fiberglass, graphite, Kevlar, etc., and others materials. In one preferred embodiment, the buttstock and/or modules are formed of injection molded polymer providing economic manufacture, weather resistance, and a variety of possible configurations, dimensions, surface texture/finishes, colors, etc. In a certain embodiment, stock 50 is made of glass reinforced polypropylene. Buttstock modules 70 further described herein may be made of similar or different materials than stock 50 including buttstock 54.

Figure 4:
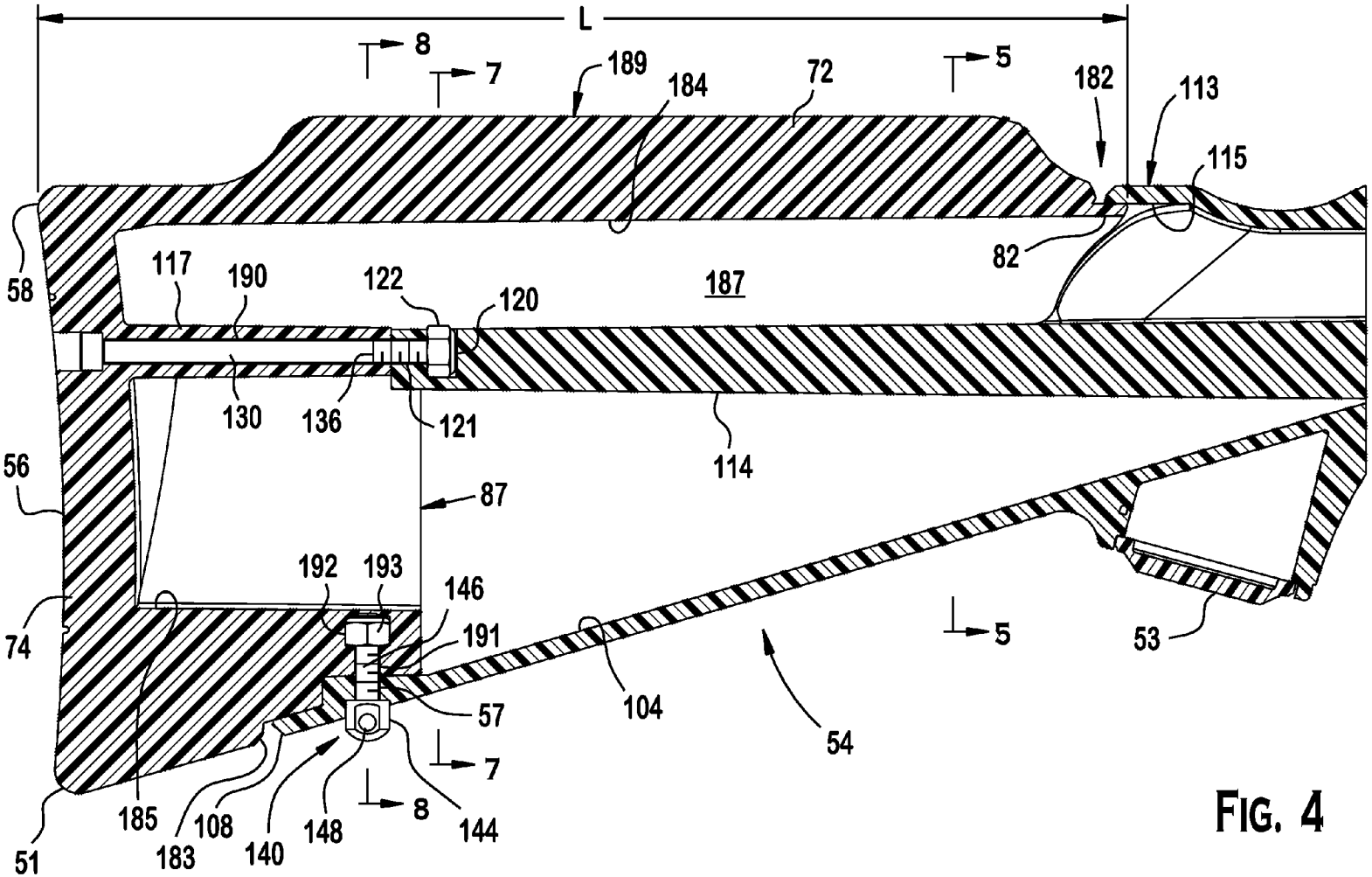
FIG. 4 is a longitudinal side cross-sectional view of the buttstock and buttstock module taken along line 4-4 in FIG. 3.
Figure 8:
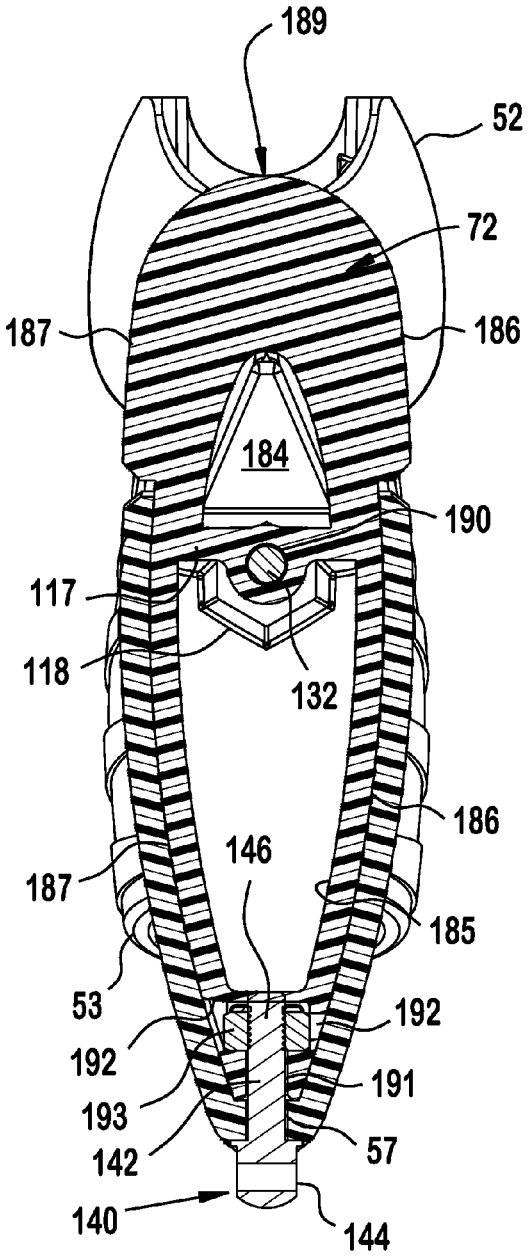
FIG. 8 is a transverse cross-sectional view of the buttstock and buttstock module taken along line 8-8 in FIG. 4 through a second mounting fastener.
Figure 9:
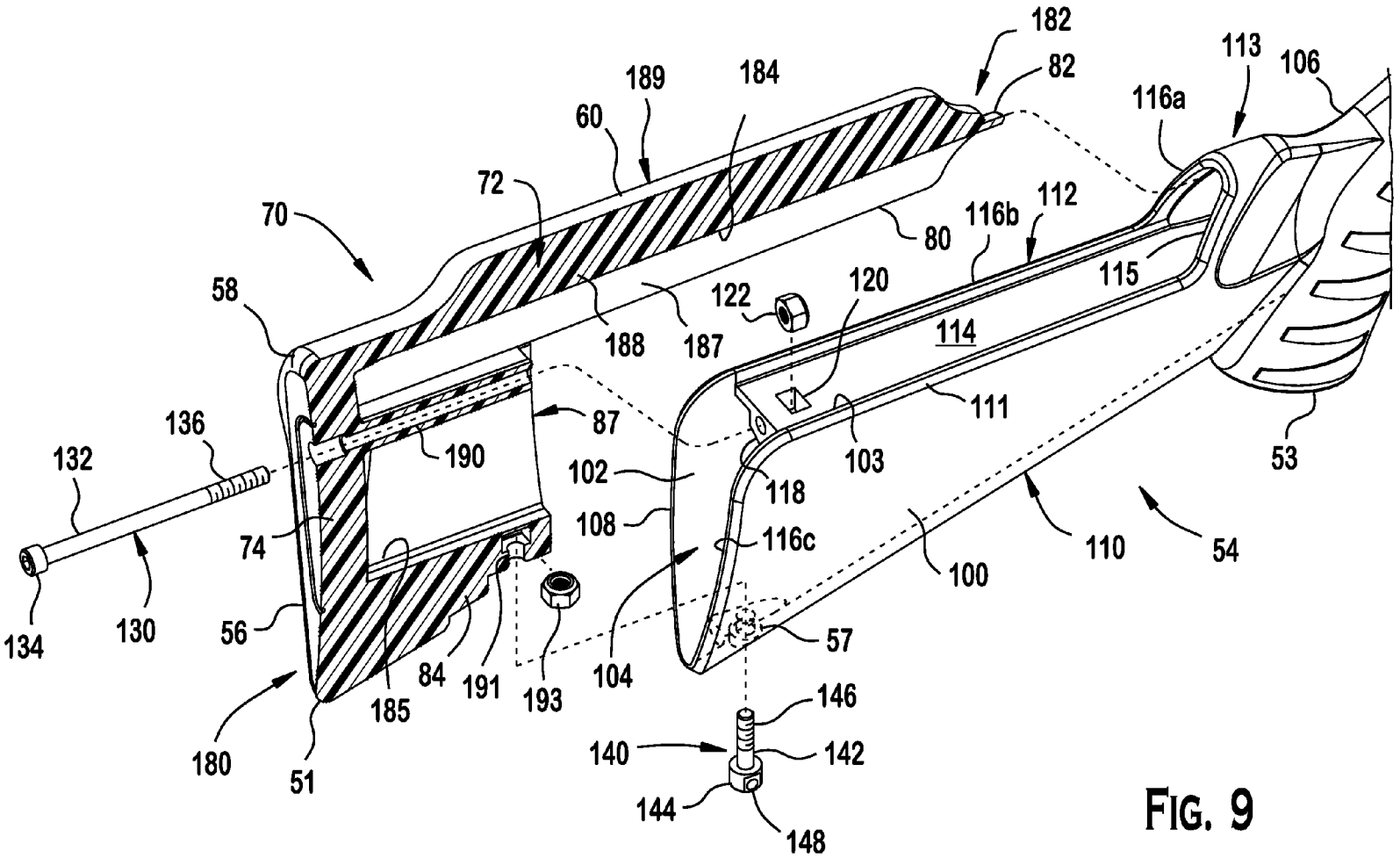
FIG. 9 is an exploded rear perspective view of the buttstock and the buttstock module shown in cross section.

In certain embodiments, rifle 20 may included a shoulder sling 55 mounted to fore-end 52 and buttstock 54 of stock 50 via swivel stud screws 140, as shown in FIGS. 1 and 2. One possible embodiment of screws 140 is shown in greater detail in FIGS. 4 and 9. Screws 140 includes a head 144 at one end and a shaft 142 having an opposite threaded end 146 configured to engage mating threaded surfaces provided in buttstock module 70, as further described herein. Buttstock 54 includes a through hole 57 configured for receiving shaft 142 and a portion of head 144 of screw 140, as shown in FIGS. 4, 8, and 9. Through hole 57 penetrates into internal cavity 104 of the buttstock 54, and may have a diametrically enlarged entry in some embodiments for receiving a portion of head 144. Head 144 of sling lug 140 may include an aperture 148 for rotatably mounting sling 55 thereto which may have a metal ring or clip at each end received through the aperture. Other suitable types of sling lugs and mounting arrangements may be provided.

Referring to FIG. 1, rifle 20 includes sights for aiming the rifle at a target including a front sight 22 and a rear sight 24. Sights 22, 24 may be considered on-board sights as they are closely coupled to barrel 30 being directly mounted on the barrel. In some embodiments, one or both sights 22, 24 may be foldable sights. Sights 22, 24 define a line of sight LS. When rifle 20 is aimed, the user's eye E is preferably axially aligned with the line of sight LS and directed downfield toward a target. A vertical distance D1 is defined between the longitudinal axis LA of rifle 20 and line of sight LS.

FIG. 2 depicts rifle 20 equipped instead with an elevated sight in the form of an optical scope 26 as are well known to those skilled in the art. Scope 26 defines a new line of sight LS different than the line of sight defined by sights 22, 24 in the embodiment of FIG. 1 not using a scope. Line of sight LS associated with scope 26 is vertically higher than the line of sight LS defined by sights 22, 24 in FIG. 1A vertical distance D2 is defined between the longitudinal axis LA of rifle 20 (defined by barrel 30 and remaining constant regardless of which sighting system is used) and line of sight LS associated with scope 26. As shown by comparing FIGS. 1 and 2, distance D2 is greater than distance D1 as scope 26 is spaced and elevated higher above barrel 30 in contrast to sights 22, 24.

The comb 60 functions to support a user's cheek at a proper height or elevation corresponding to the line of sight LS of the rifle depending on which of the foregoing sighting systems is used in FIG. 1 or 2. Ideally, the comb 60 should raise and locate the head of a user at a position when their cheek rests against the comb so that the eye E is axially aligned with the line of sight LS. As shown by comparing FIGS. 1 and 2, a taller comb 60 is desired when using a rifle 20 equipped with a scope 26 rather than when using sights 22, 24 located more proximate to barrel 30. Accordingly it is desirable for a user to be able have an interchangeable buttstock system to accommodate use of either type of sighting systems described and shown in FIGS. 1 and 2 for proper positioning of the comb 60.

It will be further appreciated that the length of the buttstock 50 should also preferably be able to accommodate differences in arm length of a user for comfort and proper positioning of the arms for supporting and aiming the rifle 20. Accordingly, it is further desirable to have an interchangeable buttstock system to vary the length of the buttstock.

Figure 3:
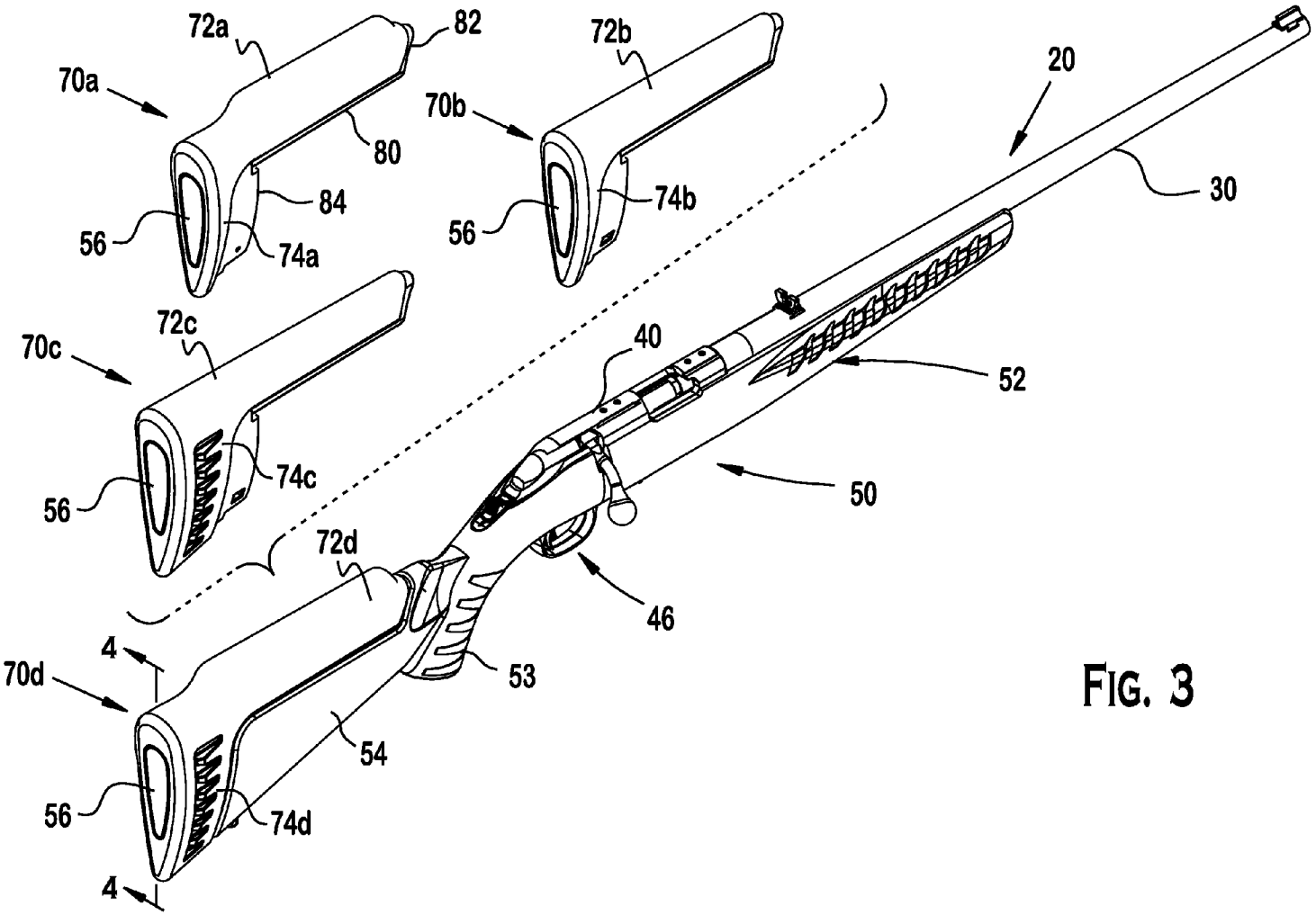
FIG. 3 is a rear perspective view of a rifle with buttstock module system and kit comprising a plurality of interchangeable buttstock modules.

FIG. 3 depicts a buttstock system having interchangeable buttstock modules that advantageously allows a user to custom fit both the height of the comb and length of the buttstock for ergonomic and rifle sighting reasons, as described herein. The buttstock system includes a plurality of user replaceable and switchable buttstock modules 70 each including an upper comb portion 72 and a rear butt portion 74 which may each be custom configured and dimensioned differently to accommodate both physical differences in users, personal preferences, and the type of sighting system being used at any given time.

Buttstock 54 is configured for detachable mounting of any one of a plurality of buttstock modules 70 all preferably sharing a common mounting mechanism and arrangement. Any suitable fastening mechanism may be used to releasably secure the buttstock modules 70 to buttstock 54 including but not limited to threaded fasteners as described herein. FIG. 4 is a longitudinal cross-section buttstock 54 taken along line 4-4 in FIG. 3. FIG. 9 is a rear perspective view of buttstock 54 and a buttstock module 70 shown in longitudinal cross-section.

Buttstock 54 and portions forming a mounting system for detachable coupling of any one of a plurality of buttstock modules 70 thereto will first be described in greater detail.

Referring now to FIGS. 4 and 9, buttstock 54 in one embodiment is a substantially hollow and axially elongated structure having an opposing right sidewall 100 and left sidewall 102, a front end 106 terminating at grip 53, an open rear end 108, a closed bottom 110, and open top 112. Sidewalls 100 and 102 define a longitudinally and axially extending internal cavity 104 for reducing weight and which is configured for insertably receiving a portion of buttstock module 70 therein. In certain embodiments, sidewalls 100 and 102 may be disposed at an acute angle with respect to each other and define an internal cavity 104 that is generally V-shaped in transverse cross section as best shown in FIGS. 5-9.

Figure 5:
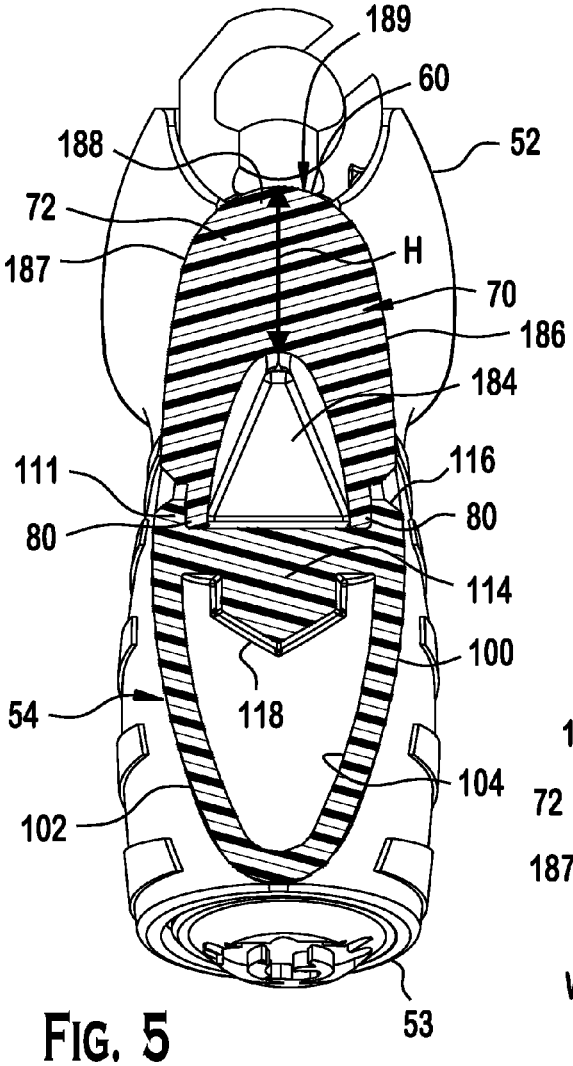
FIG. 5 is a transverse cross-sectional view of the buttstock and buttstock module taken along line 5-5 in FIG. 4 showing a first embodiment of buttstock module having a raised buttstock comb.
Figure 6:
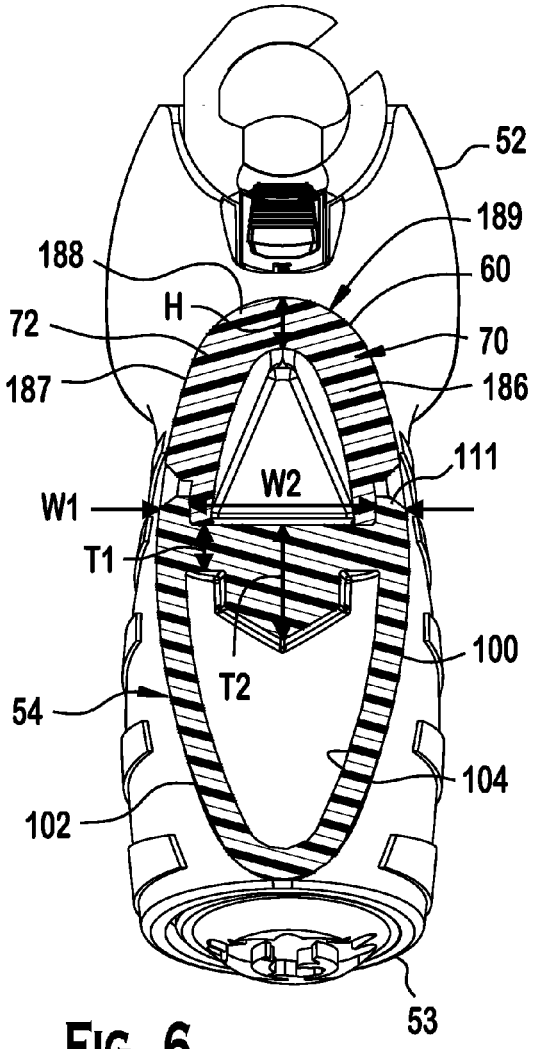
FIG. 6 is a transverse cross-sectional view of the buttstock and buttstock module similar to FIG. 5 but showing a buttstock module having a flat buttstock comb that is vertically shorter than the comb of the buttstock module in FIG. 5.

Referring to FIGS. 4-9 and 11, a partition wall 114 extends longitudinally and laterally/transversely across cavity 104 between sidewalls 100, 102 and lies in a substantially horizontal plane. In one embodiment, partition wall 114 is disposed proximate to open top 112 of buttstock 54, and preferably recessed or spaced below longitudinally-extending top edges **116*b* defined by the top of sidewalls 100 and 102 thereby forming an axial channel 103. Partition wall 114 closes cavity 104 on top and forms a recessed platform at the bottom of the channel 103 having a top surface configured and arranged to abuttingly engage corresponding downwardly extending side mounting flanges 80 formed on the bottom of buttstock modules 70 (see, e.g. FIGS. 5-9 and 11). Accordingly, in one embodiment, partition wall 114 is spaced vertically below top edges 116*b* of sidewalls 100 and 102 thereby defining vertically short stub walls 111 on the upper portions of the sidewalls 100, 102 that rise and extend vertically upwards above and from the top surface of partition wall 114. Side mounting flanges 80 are insertable into the channel 103. Accordingly, as shown in FIG. 6, the outer lateral surfaces of side mounting flanges 80 have a width W1 that is smaller than the width W2 on sidewalls 100 and 102 adjacent stub walls 111. Width W1 is selected so that the side mounting flanges 80 may be inserted into channel 103**.

In one embodiment, partition wall 114 is substantially planar or flat to complement the shape of the bottom abutment surfaces on side mounting flanges 80 of the buttstock modules 70. This provides smooth slideable axial insertion of the modules 70 into buttstock 54 as further described herein.

Partition wall 114 may further include a downwardly extending enlarged protrusion such as mounting block 118 configured for receiving a fastening element such as threaded mounting fastener 130 which may be used in one embodiment to secure buttstock module 70 to buttstock 54 (see, e.g. FIGS. 4-9). Mounting block 118 provides additional purchase and a physically robust structure for securing buttstock module 70 to the buttstock 54 with fastener 130. Correspondingly, this favorably allows partition wall 114 to have a smaller lateral or transverse vertical thickness T1 than the lateral or transverse vertical thickness T2 of mounting block 118 to minimize the weight of buttstock 54 (thicknesses annotated in FIG. 6). In alternative embodiments where weight reduction is not a prime goal, partition wall 114 may instead be made vertically thicker (T1) for engaging fastener 130 and mounting block may be eliminated albeit with a concomitant increase in weight of buttstock 54. Mounting block 118 may be centrally located in buttstock 54 approximately midway between right and left sidewalls 100, 102 (see, e.g. FIGS. 5-8) and is accessible through the open rear end 108 of the buttstock.

Figure 7:
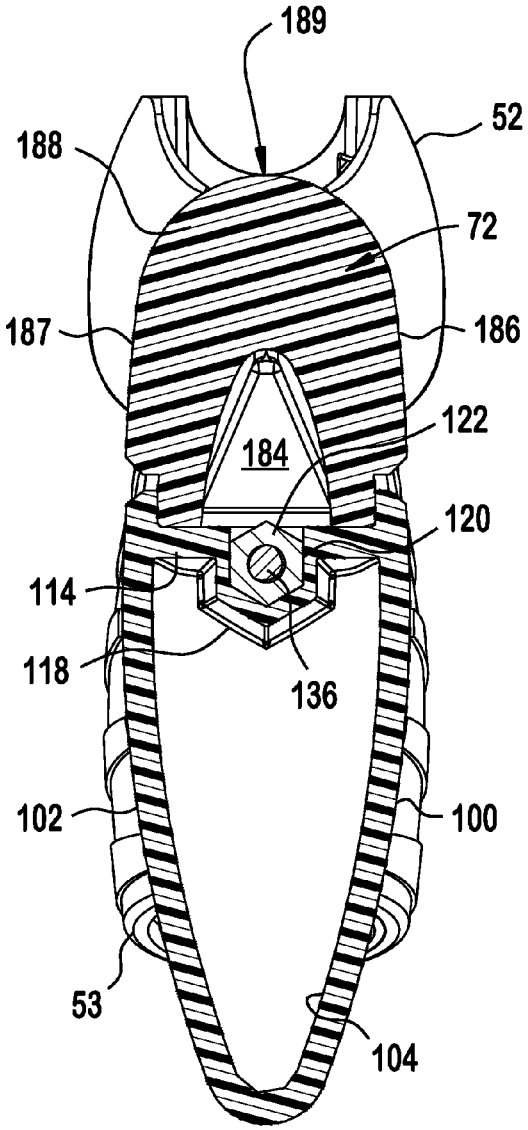
FIG. 7 is a transverse cross-sectional view of the buttstock and buttstock module taken along line 7-7 in FIG. 4 through a mounting fastener.

To provide a threaded surface for engaging a mating threaded end 136 of mounting fastener 130 insertable through part of buttstock module 70 and buttstock 54, a specially configured receptacle 120 is formed in partition wall 114 and mounting block 118 which receives a fastening element such as threaded hex nut 122. Receptacle 120 has a transverse configuration which conforms at least in part to the hex shape of nut 122. Accordingly, in one embodiment, as shown in FIGS. 5-7, mounting block 118 may have a half-hexagonal cross-sectional shape. Receptacle 120 has a closed bottom to retain hex nut 122 and an open top that fully penetrates partition wall 118 allowing for insertion of the nut. The parallel sidewalls and bottom of receptacle 120 are mutually and complementary configured and dimensioned in transverse cross-section with hex nut 122 as best shown in FIG. 7 to prevent rotation of the nut when fastener 130 is turned into the nut during the buttstock module mounting process. Accordingly, receptacle 120 is preferably sized relatively close to the transverse outer dimensions of hex nut 122 so that the nut frictionally engages the surfaces in buttstock 54 surrounding the receptacle when the nut is slid into the receptacle. Hex nut 122 is held in receptacle 120 by frictional resistance between the closely sized receptacle walls and nut to prevent the nut from falling out of buttstock 54 if inverted.

In some embodiments, an elongated axial bore or hole 121 as shown in FIGS. 4 and 9 may be provided in mounting block 118 that opens rearward and communicates with receptacle 120 for inserting mounting fastener 130 therethrough. Hole 121 becomes a concentrically aligned and communicates with axial hole 190 in buttstock module 70 when the buttstock module is mounted in the buttstock 54.

Mounting block 118 also extends axially parallel to longitudinal axis LA for a distance sufficient to receive and securely engage threaded end 136 of fastener 130, as shown in FIG. 4. In one embodiment, mounting block 118 extends for a majority of the length of the buttstock 54 from grip 53 rearwards to or proximate to rear end 108. In one embodiment, mounting block 118 is spaced axially forward of buttstock rear end 108 as best shown in FIGS. 4 and 9 to provide space for a portion of buttstock module 70 to be axially inserted into cavity 104 and seated within the rear end of buttstock 54.

It will be appreciated that the combination of hex nut 122 and receptacle 120 provides one economic manner of providing a threaded surface in buttstock 54 for engaging threaded mounting fastener 130. In various other embodiments, the threaded mounting element in buttstock 54 may alternatively be formed in metallic inserts, bushings, or similar elements non-rotationally affixed to mounting block 118 and/or partition wall 114. In yet other embodiments, non-threaded fastening elements may be used which function via releasable mechanically interlocking features (e.g. protrusions/grooves-recesses, spring clips and detents, latches, levers, etc.) to mount buttstock modules 70 to buttstock 54. Accordingly, the invention is expressly not limited to the use of a hex nut or threaded fastening elements as a fastening mechanism for securing buttstock modules 70 to buttstock 54. Numerous other types of fastening mechanisms for securing the buttstock modules 70 to buttstock 54 are therefore possible and may be used.

Referring now to FIGS. 4 and 9, buttstock 54 further includes an enlarged raised front portion 113 adjacent front end 106 that defines a rearwardly open socket 115 configured for insertably receiving a forwardly projecting mounting flange 82 on buttstock module 70 (see also FIG. 3). Socket 115 may have a generally inverted U-shaped opening in one embodiment as shown which is complementary in configuration to mating front flange 82 of buttstock module 70 (see FIG. 13). Raised front portion 113 defines an inverted U-shaped front edge **116*a* which surrounds socket 115 near the front end 106 of buttstock 54**, and which is generally vertically oriented and may be slightly angled or sloping rearward with respect to the vertical plane and longitudinal axis LA.

Open rear end 108 of buttstock 54 defines a rear edge **116*c* as shown in FIG. 4. In one embodiment, rear edge 116*c*, longitudinally-extending top edges 116*b*, and front edge 116*a* may be contiguous in structure and are complementary configured to mate with contiguous front edge 86, side edges 181, and rear butt portion forward edge 183 of buttstock module 70 (see FIG. 13) so that the buttstock module transitions smoothly and blends into the buttstock when assembled without any appreciable gaps, as shown for example in FIGS. 1-3**.

Figure 10:
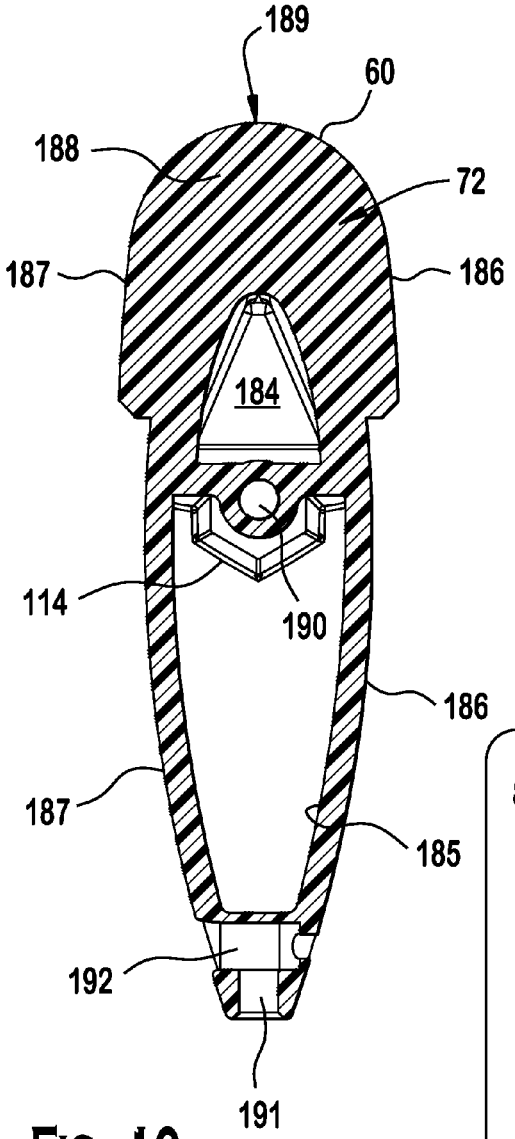
FIG. 10 is a transverse cross-sectional view of the buttstock module of FIG. 8 shown alone.
Figure 11:
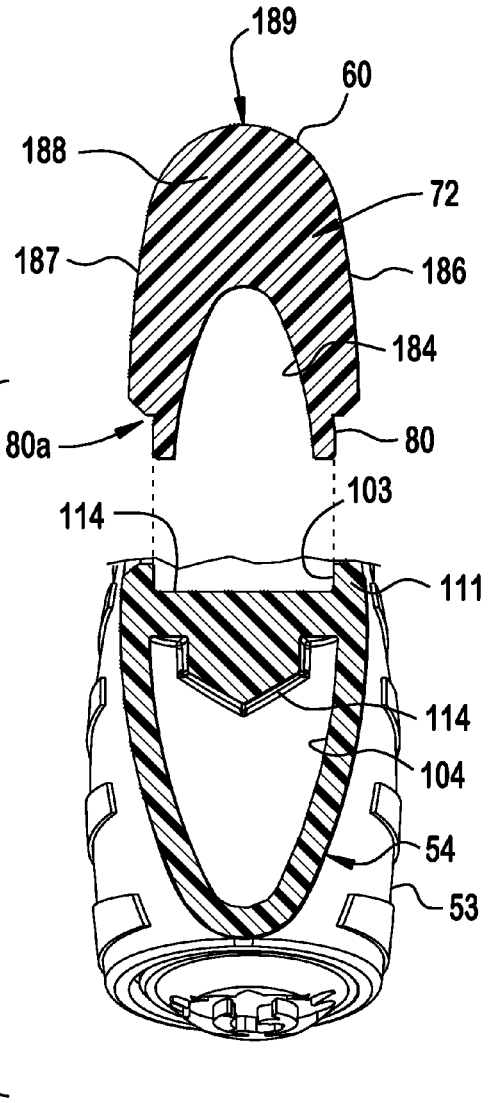
FIG. 11 is an exploded transverse cross-sectional view of the buttstock module and buttstock of FIG. 5.

Buttstock modules 70 will now be further described in detail with reference to FIGS. 3-12. FIG. 11 is an exploded view of FIG. 5 (without fore-end 52 for clarity). FIG. 10 is a transverse cross-sectional view of the buttstock module 70 alone shown in FIG. 8 (without buttstock 54) to more clearly show features of the buttstock module.

In one embodiment, the comb 60 and butt 56 of stock 50 are disposed on the removably mountable and interchangeable buttstock modules 70 which interlock with buttstock 54. Accordingly, in this embodiment each buttstock module 70 includes a rear end 180, a front end 182, upper comb portion 72 extending longitudinally and horizontally between the rear and front ends, and rear butt portion 74 extending vertically between heel 58 and toe 51. Upper comb portion 72 defines comb 60 and rear butt portion 74 defines butt 56.

Buttstock module 70 includes two opposing and longitudinally-extending sidewalls 186, 187 which in part define upper comb portion 72 and rear butt portion 74. Sidewalk 186, 187 have a reduced height in upper comb portion 72 as shown in FIGS. 3, 4, and 9, and in rear butt portion 74 these sidewalls extend from heel 58 to toe 51 (compare FIGS. 7 and 8). Sidewall 186 defines a right sidewall and sidewall 187 defines a left sidewall from the vantage point of a user looking forward from the rear towards muzzle end 32 of the rifle 20.

Upper comb portion 72 further defines a top wall 188 connecting the sidewalls 186, 187 together which collectively form a downwardly open cavity 184. The vertical transverse cross-sectional height H (or thickness) of the upper comb portion 72 formed by top wall 188 can be varied in manufacture of buttstock module 70 to form combs 60 of different heights (compare, e.g. FIGS. 5 and 6). For example, a flat comb 60 may be provided as shown in FIGS. 1 and 6 (having a straight top surface 189 extending longitudinally between rear end 180 and front end 182 along top wall 188) or a raised comb 60 shown in FIGS. 2, 4, 5, and 11 (having a raised ridge with vertically elevated top surface 189 extending longitudinally between rear end 180 and front end 182 along top wall 188). In certain embodiments of a raised comb 60 as shown, a stepped portion is formed at the front and rear of the raised ridge where the top surface 189 transitions down to the front end 182 and rear end 180 respectively. This advantageously allows the butt 56 to have a common height between heel 58 and toe 51 regardless of whether a straight or raised comb 60 buttstock module 70 is used. In addition, this ensures that the front end 182 having a portion insertable into socket 115 in buttstock 54 will consistently fall at the same position for mounting the buttstock module to the buttstock allowing to single buttstock module mounting arrangement to be used for either style of comb.

Referring to FIGS. 3, 4, 9, and 12, the lower portions of sidewalls 186, 187 define a pair of laterally spaced apart downwardly and longitudinally extending side mounting flanges 80 configured to slidably and frictionally engage stub walls 111 formed by the upper portions of the sidewalls 100 and 102 and partition wall 114 of buttstock 54 (see also FIGS. 5-7). Accordingly, stub walls 111 and partition wall 114 define an upwardly open and longitudinally-extending socket configured and dimensioned to receive at least part of the upper comb portion 72 of buttstock module 70 which includes side mounting flanges 80 therein. As best shown in FIGS. 5-7 and 11, side mounting flanges 80 are laterally inset from longitudinally extending side edges 181 and the outer surfaces of each sidewall 186, 187, thereby forming longitudinally-extending stepped recesses 80*a* (see FIG. 10) which slidably receive and frictionally engage stub walls 111 of buttstock 54 when axially mounting the buttstock modules 70 to the buttstock from the rear, as further described herein. Accordingly, in one configuration, side mounting flanges 80 have a smaller lateral transverse thickness than portions of sidewalls 186, 187 above the flanges as shown (see FIGS. 5-7). This also provides a substantially flush outer surface between the buttstock 54 and buttstock module 70 for user when the module is mounted on the buttstock.

In one embodiment, side mounting flanges 80 may be arranged in a converging relationship with respect to each other to complement a similar converging relationship between top edges 116*b* of sidewalls 100 and 102 (including stub walls 111) on buttstock 54 (see, e.g. FIG. 9). The flanges 80 and stub walls 111 gradually converge from butt 56 on rear end 180 of buttstock module 70 and come nearest to each other, but do not intersect near the front end 106 of the buttstock 54. As buttstock module 70 is axially and slidably inserted into buttstock 54 from the rear, the converging relationship of each component's somewhat V-shaped mounting portions (i.e. side flanges 80 and stub walls 111) produce a wedging action and frictional fit to tighten the engagement between the buttstock module and buttstock, thereby providing a secure and relatively snug mount.

Figure 12:
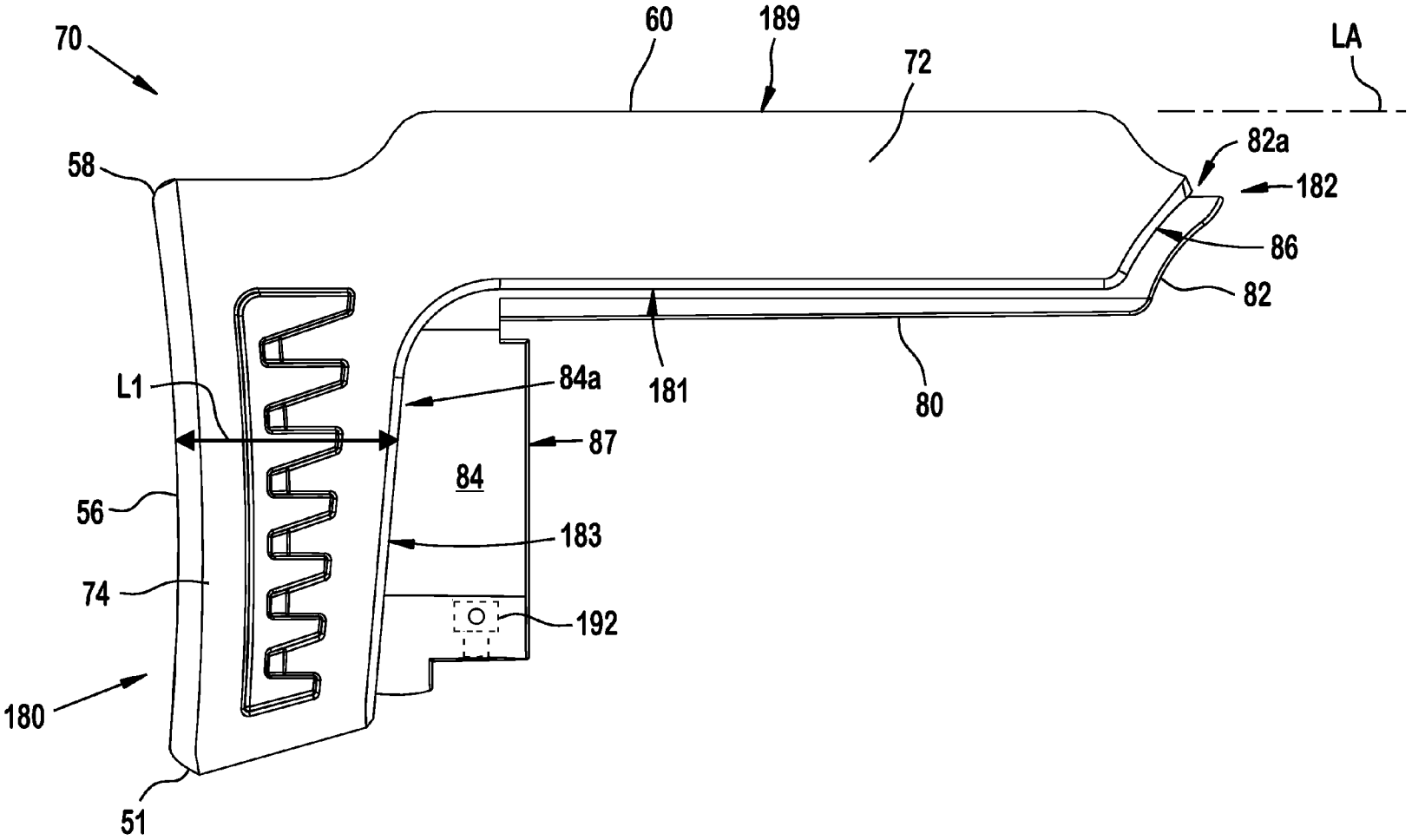
FIG. 12 is a side elevation view of the buttstock module.

As shown in FIGS. 3 and 12, side mounting flanges 80 and front mounting flange 82 in one embodiment may form a contiguous lip-like structure extending across the from end 182 of buttstock module 70 and rearwards along both lateral sides 186, 187 to rear butt portion 74. Accordingly, in one embodiment, front mounting flange 82 may connect opposing side mounting flanges 80 across the front of the buttstock module 70. In other possible embodiments contemplated, each side mounting flange 80 may be alternatively formed of intermittently and longitudinally spaced separate structures with gaps therebetween. Side mounting flanges 80 may terminate at partition wall 117 at the rear (see FIG. 13).

Referring to FIGS. 3, 4, 9, and 12, front end 182 of buttstock module 70 includes a front mounting flange 82 projecting forward from front end 182 which is configured and dimensioned for axial insertion into socket 115 in raised portion 113 of buttstock 54. In the embodiment shown, front mounting flange 82 has a generally inverted U-shaped transverse cross section and socket 115 has a complementary configured opened to provide sliding frictional engagement with the flange. Front mounting flange 82 may have a vertical thickness that is less than front end 182 to allow for a relatively smooth transition between the top portion of buttstock module 70 and front end 106 of buttstock 54 as best shown in FIG. 4. The front mounting flange 82 is inset vertically below front edge 86 and top surface 189 at front end 182 of buttstock module 70 as shown in FIGS. 4 and 12, thereby forming a stepped recess 82*a* which slidably receives the rear end of buttstock socket 115. Preferably, front mounting flange 82 is completely insertable into buttstock socket 115 so that the flange is not significantly visible when seated in raised portion 113 of the buttstock and a substantially flush joint and transition is formed between the front end 182 of buttstock module 70 and the buttstock.

Buttstock module 70 further includes a rear mounting flange 84 projecting forward from rear butt portion 74, as shown in FIGS. 3, 4, 9, and 12. Rear mounting flange 84 is also laterally inset from the outer surfaces of sidewalls 100, 102 forming stepped recesses 84*a* so that the flange is insertable into the rear end 108 and cavity 104 of buttstock 54. Preferably, rear mounting flange 84 is completely insertable into buttstock 54 so that the flange is not significantly visible when seated in rear end 108 of the buttstock and a substantially flush joint and transition is formed between rear butt portion 74 and the buttstock. In the embodiment shown, rear mounting flange 84 has a generally U-shaped transverse cross section and rear end 108 of the buttstock 54 has a complementary configured opened to provide sliding frictional engagement with the flange.

Rear butt portion 74 of buttstock module 70 further defines a forwardly open cavity 185 at least in part for weight reduction (see, e.g. FIGS. 4, 8, 9, and 13). For mounting purposes, rear butt portion 74 may further include an axially elongated bore 190 configured and dimensioned for insertion of shaft 132 of mounting fastener 130 therethrough. In one embodiment, axial bore 190 is formed in a horizontal partition wall 117 in rear butt portion 74 which abuts partition wall 114 of buttstock 54 (see FIG. 4) when the buttstock module 70 is mounted to the buttstock. Partition wall 115 separates cavity 185 from cavity 184 in buttstock module 70 as shown in the foregoing figures.

Referring to FIGS. 4, 8-10, and 13, rear butt portion 74 further includes a vertical bore 191 configured and dimensioned for insertion of shaft 142 of swivel stud screw 140 there through (see FIGS. 4, 8, and 9). Swivel stud screw 140 may also serve to mount and secure buttstock module 70 to buttstock 54 in addition to or instead of mounting fastener 130. As best shown in FIG. 8, a lateral passageway 192 may be provided in buttstock module 70 which extends through one or both sidewalls 186, 187 and which communicates with vertical bore 191. Passageway 192 is configured and dimensioned to slidably and frictionally receive hex nut 193 therein. Hex nut 193 is threadably engageable with swivel stud screw 140. One lateral side of passageway 192 may have a reduced height (e.g. right side shown FIG. 8) which is shorter than the height of hex nut 193 so that the nut can only be pushed and slid into passageway 192 from one side (e.g. left side shown in FIG. 8). Hex nut 193 may be pushed back out of passageway 192 to the left from the right reduced height section of the passageway using a probe or tool.

Figure 13:
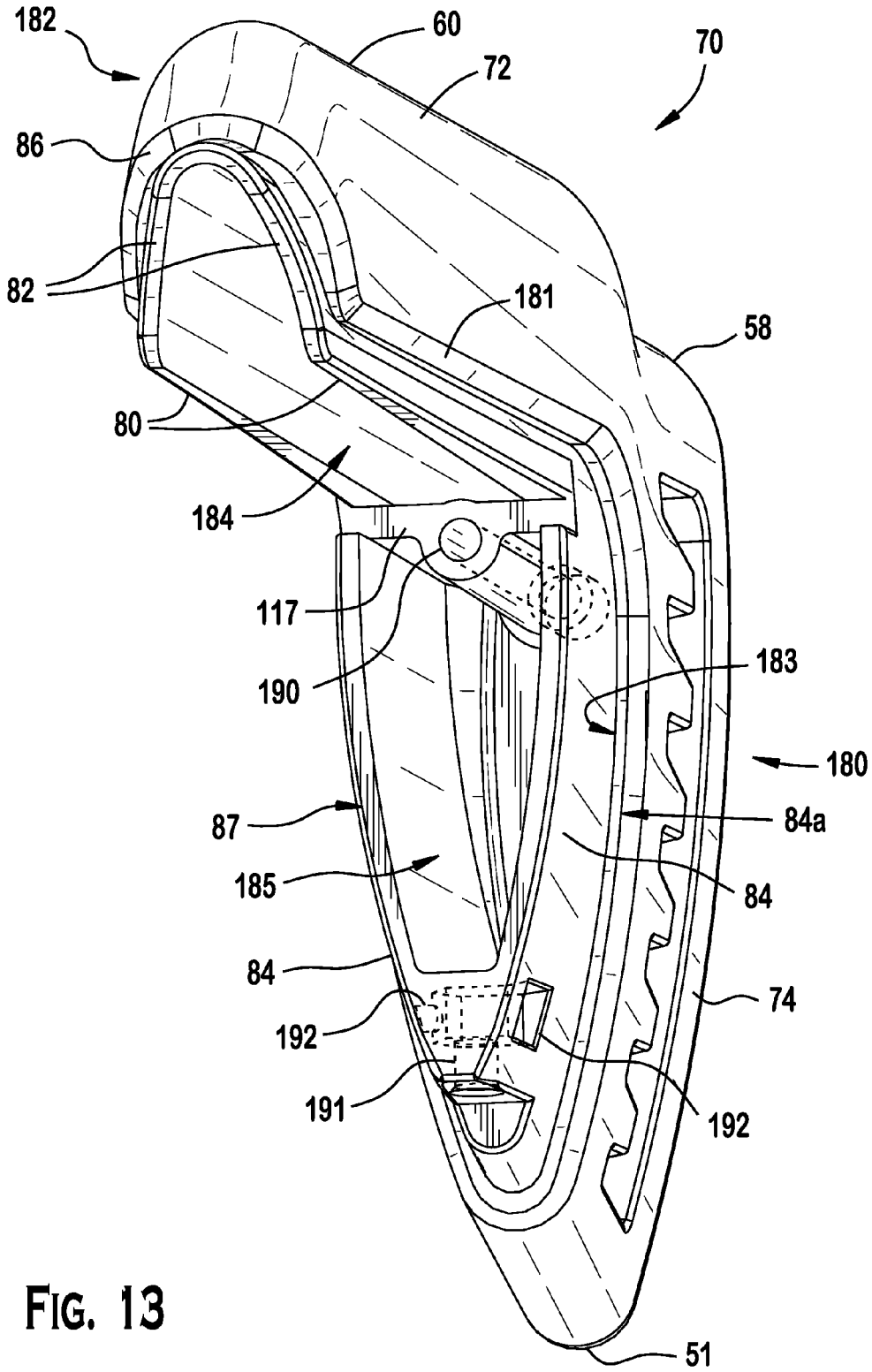
FIG. 13 is a front perspective view of the buttstock module.

In addition to a customizable upper comb portion 72, buttstock modules 70 can also advantageously be varied in length to provide a customizable rear butt portion 74 to fit a user's needs and preferences (see, e.g. FIG. 3). Referring to FIG. 12, rear butt portion 74 of buttstock module 70 has a nominal axial longitudinal length L1 defined herein as being between the butt 56 and vertical forward edge 183 of rear butt portion 74 measured at approximately mid-height vertically along the butt. Length L1 may be adjusted in length as shown in the various embodiments of FIG. 3 to provide a short or long buttstock. It should be noted that rear mounting flange 84 is inset laterally inwards from forward edge 183 of the buttstock rear butt portion 74 (e.g. into the page when viewed in FIG. 12 and as shown in FIG. 13) and is completely inserted and nested inside the open rear end 108 of the buttstock 54 so that only the length L1 of rear butt portion 74 affects the length of the buttstock module.

FIG. 3 illustrates four possible non-limiting examples of buttstock modules 70 having different customized configurations and dimensions. Buttstock module 70*a* includes a raised high profile comb portion 72*a* and short compact length rear butt portion 74*a*. Buttstock module 70*b* includes a flat profile comb portion 72*b* and compact length rear butt portion 74*b*. Buttstock module 70*c* includes flat profile comb portion 72*c* and comparatively longer extended length rear butt portion 74*c* than buttstock modules 70*a* and 70*b*. Buttstock module 70*d* (shown mounted on buttstock 54) includes a raised high profile comb portion 72*d* and extended length rear butt portion 74*d*. All buttstock modules shown are removably interchangeable with single buttstock 54. Other configurations of modules may be provided.

In a preferred embodiment, buttstock modules 70 are formed of a polymer by molding as a single unitary structural element including some or all of the foregoing features described herein. In some embodiments, the butt 56 of buttstock module 70 may include a soft resilient rubber recoil pad 200 (see, e.g. FIGS. 14-15 and as further described herein) for recoil reduction which may be insert molded or overmolded with or separately attached to the buttstock module.

In addition to having different lengths and/or comb configurations, buttstock modules 70 described herein may further include unique ornamental design elements including different surface markings, patterns (e.g. camouflage), raised/recessed features (see, e.g. serrated design feature best shown in FIG. 12), colors, surface textures (e.g. checkering), and others. Accordingly, a kit of user replaceable buttstock modules 70 may be provided in some embodiments including a plurality of buttstock modules having at least one of different configurations, dimensions, and/or ornamental design elements for a user to select from. The kit may further include a buttstock 54 configured and arranged to detachably receive one of the plurality of buttstock modules 70 at a given time.

An exemplary method for mounting a buttstock module 70 to a buttstock buttstock 54 of stock 50 will now be described. In one embodiment in which a buttstock module kit may be provided as described above, the method may first include selecting a buttstock module 70 from a plurality of buttstock modules having at least one of different configurations, dimensions, and/or ornamental design elements. In some embodiments, this may include a first buttstock module 70 already mounted on the buttstock 54 of rifle 20 and one other second buttstock module interchangeable with the first buttstock module.

Assuming a buttstock module 70 is not already in buttstock 54 as in FIG. 9, the user generally positions the buttstock module at least partially to the rear of the buttstock somewhat similar to the position shown in this figure. Rear butt portion 74 and rear mounting flange 84 of buttstock module 70 are located and positioned axially behind open rear end 108 of buttstock 54. In this pre-insertion position, the front end 182 and front mounting flange 82 of buttstock module 70 may also be aligned substantially axially along longitudinal axis LA with rearwardly open socket 115 in raised front portion 113 of buttstock 54. Preferably, in one embodiment, the forward portions of side mounting flanges 80 may initially be lowered into contact with the top surface of the rear portion of partition wall 114 in the buttstock 54 and at least partially engaged with stub walls 111 on each lateral side of the buttstock. This will assist with next slidably guiding the buttstock module 70 forward for full insertion and mounting into buttstock 54.

With continuing reference to FIG. 9, buttstock module 70 is next axially moved and slid forward into buttstock 54 with side mounting flanges 80 slidably moving along partition wall 114 towards open socket 115 of the buttstock 54. Front mounting flange 82 is axially inserted into the rearwardly open socket 115 and front end 87 of rear mounting flange 84 is axially inserted into rearwardly open rear end 108 and cavity 104 of buttstock 54. With additional reference to FIGS. 1, 2, 4, and 12, the buttstock module 70 is fully seated in and mounted to buttstock 54 when front end 182 is proximate to or abuttingly contacts raised portion 113 of the buttstock and forward edge 183 on rear butt portion 74 of buttstock module 70 is proximate to or abuttingly engages rear end 108 of the buttstock.

When buttstock module 70 is fully seated in buttstock 54, vertical bore 191 in the buttstock module become concentrically aligned with through hole 57 of the buttstock as shown in FIGS. 4 and 8. Hex nut 193 was previously pre-inserted and installed into lateral passageway 192 of buttstock module 70 prior to inserting the buttstock module into buttstock 54. To secure the buttstock module 70 to the buttstock 54, threaded end 146 of swivel stud screw 140 is slidably inserted vertically upwards through the through hole 57 and vertical bore 191, and then rotated to threadably engage hex nut 193 until tightened. Buttstock module 70 is fully mounted and cannot be axially withdrawn from buttstock 54 without first removing the swivel stud screw.

In alternative embodiments using mounting fastener 130 in addition to or instead of swivel stud screw 140, threaded end 136 of mounting fastener 130 is axially slidably inserted forward through concentrically aligned axial hole 190 in buttstock module 70 and axial hole 121 in mounting block 115 of buttstock 54, and then rotated to threadably engage pre-installed hex nut 22 until tightened (see FIGS. 4 and 7). Mounting fastener 130 may be used in addition to swivel stud screw 140 for securing buttstock module 70 to buttstock 54 for higher caliber centerfire ammunition cartridges which generate greater recoil forces upon discharging rifle 20.

To remove buttstock module 70 for exchange with another buttstock module, the foregoing steps are simply reversed.

It will be appreciated that in certain embodiments, the buttstock module 70 and buttstock 54 may include certain mounting features described herein alone or in various combinations. These mounting features of the buttstock module 70 include the forwardly projecting front mounting flange 82, the downwardly projecting pair of longitudinal side mounting flanges 80, and the forwardly projecting rear mounting flange 84 (see, e.g. FIG. 12) in conjunction with each of these buttstock module mounting feature corresponding mounting portions of the buttstock 54 as already described herein.

Figure 14:
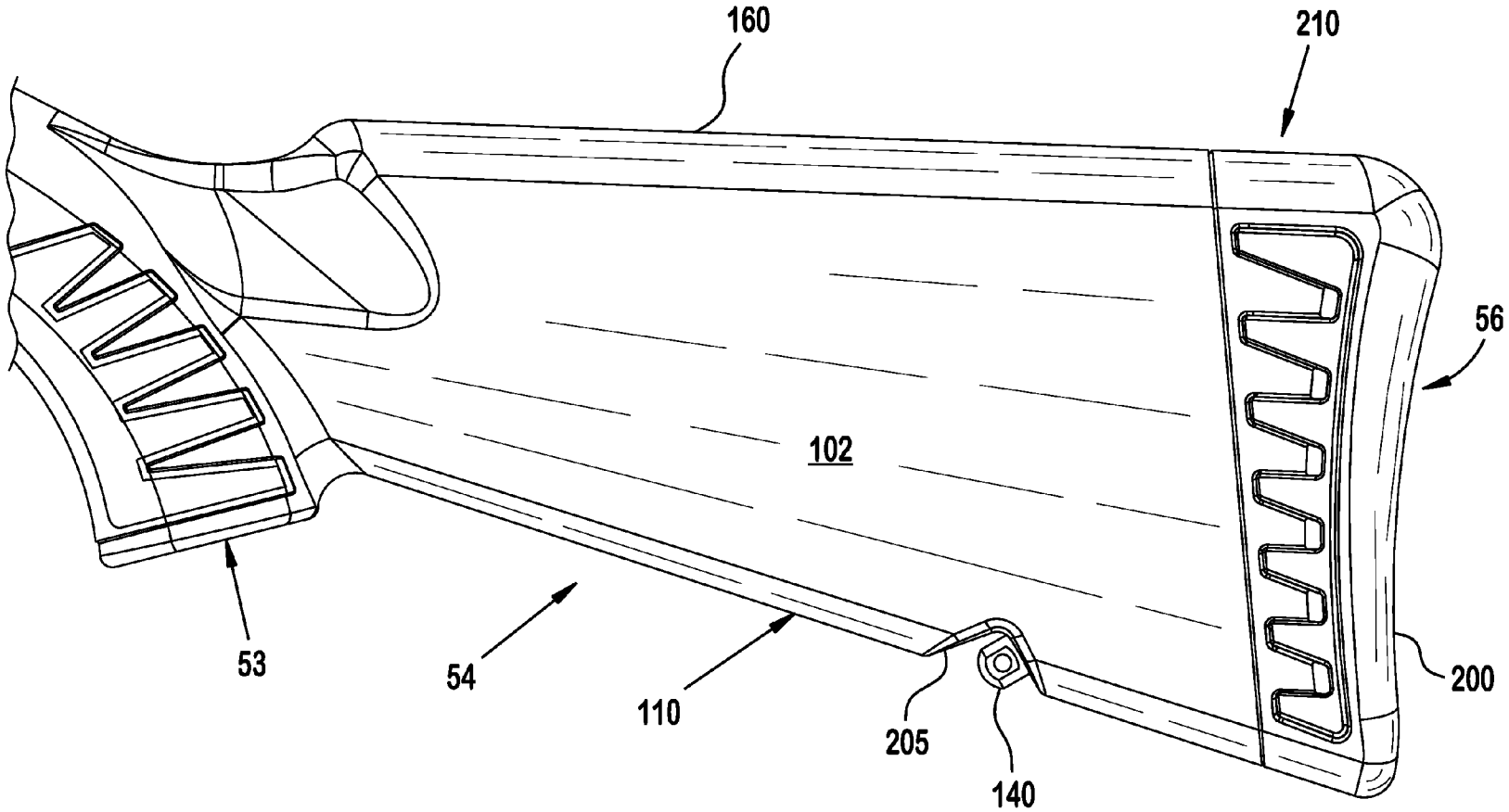
FIG. 14 is a side elevation view of the buttstock with a sling swivel screw and butt pad mounting assembly useable with the interchangeable buttstock module system disclosed herein or a conventional buttstock construction without modules.
Figure 15:
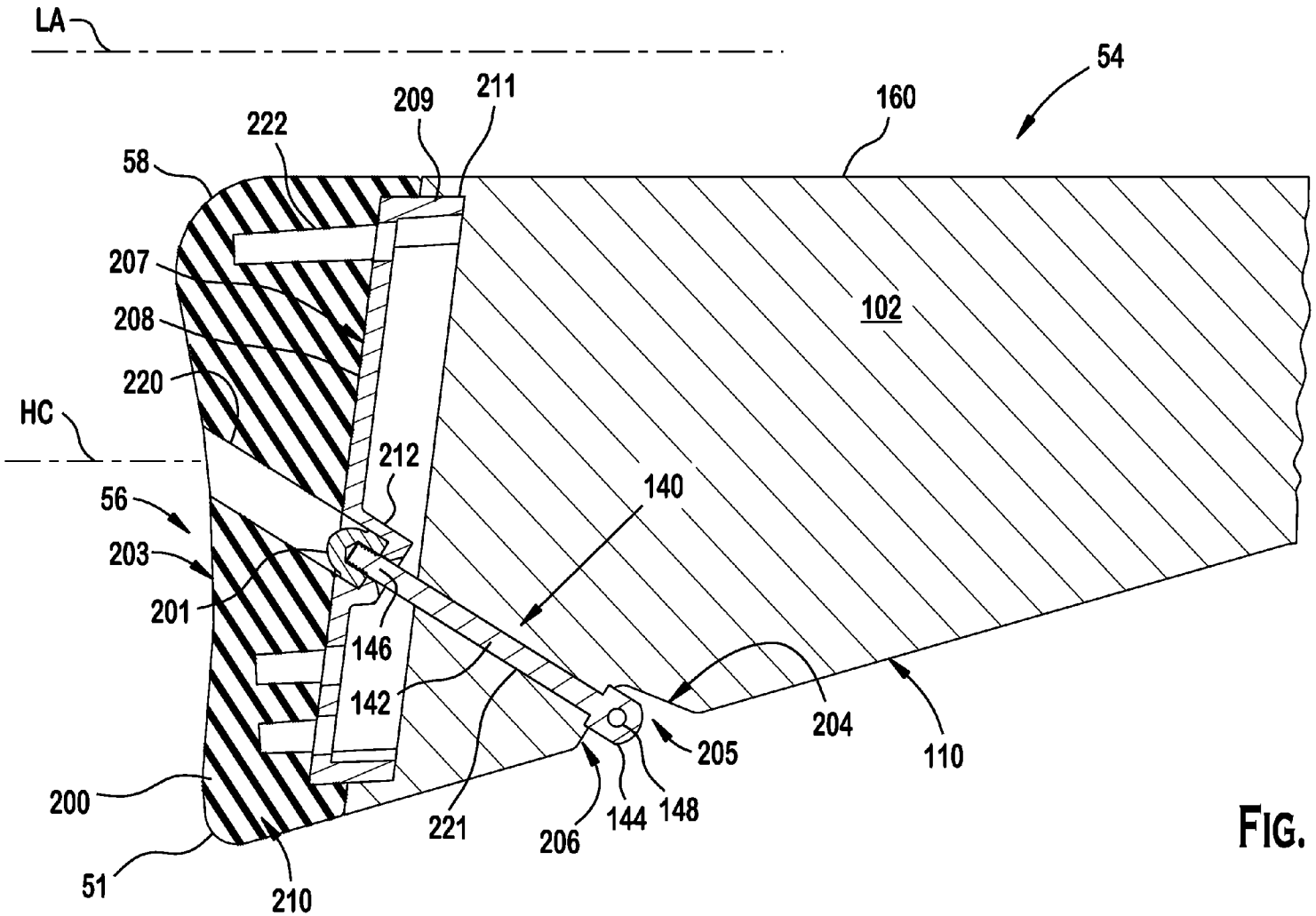
FIG. 15 is a side cross sectional view thereof.

FIGS. 14 and 15 show an exemplary embodiment of a replaceable recoil pad assembly 210 including recoil pad 200 and associated mounting insert 208. Recoil pad 200 may be made of a resilient elastomeric material with an elastic memory such as without limitation natural or synthetic (polymeric) rubbers. Mounting insert 208 is formed of a comparatively harder material and disposed on a forward portion of the pad 200. Insert 208 is configured for mounting the recoil pad assembly 210 to the rear end of the buttstock 54 or a buttstock module 70. The insert 208 may be formed of any suitable material including metal or preferably hard plastic having a greater hardness and stiffness than the pad 200 to provide structural support for the pad.

Recoil pad 200 may be attached to insert 208 in any suitable manner, including mechanical means (e.g., fasteners, adhesives, etc.) or via insert molding or overmolding. Mounting insert 208 may include one or more rear-extending molded studs 222 to help support and retain recoil pad 200 on the insert when molded thereto. In one embodiment, insert 208 defines a generally flat vertical oriented wall 207 and may include an axially forward protruding flange 209 which is at least partially received in and engages a rearward facing recessed shoulder 211 formed in rear end 108 of buttstock 54.

Recoil pad 200 is vertically elongated in configuration and defines heel 58 and toe 51 of the buttstock 54. To removably fasten recoil pad assembly 210 to buttstock 54, an extended length version of swivel stud screw 140 may be provided which advantageously serves the dual function of both fastening the pad and providing an attachment location for a sling 55 via aperture 148, thereby eliminating additional screws for mounting the pad assembly 210 to the buttstock. In other respects, stud screw 140 may be similar to that already described herein including a head 144 defining aperture 148 at one end of a shaft 142 and opposite threaded end 146 configured to engage hex nut 201. In one embodiment, hex nut 201 may be an acorn or dome nut.

In one embodiment, mounting insert 208 of the recoil pad assembly 210 may include a generally rearwardly open socket 212 configured for receiving and holding nut 201 as shown in FIG. 15. Socket 212 may have a larger diameter rear opening for insertion of the nut 201 and a smaller diameter frontal opening for receiving shaft 142 of swivel stud screw 140. Accordingly, socket 212 is axially aligned with an elongated passageway 221 formed in buttstock 54 for receiving swivel stud screw 140.

In one embodiment, the nut 201 may be inserted and positioned into socket 212 prior to overmolding the recoil pad 200 onto the mounting insert 208. In alternative embodiments, an elongated passageway 220 may be provided to access hex nut 201 which extends through the recoil pad 200 at an oblique angle to the longitudinal axis LA and horizontal centerline HC of the buttstock. Passageway 220 may penetrate rear surface 203 of recoil pad 200 and allows the nut 201 to be inserted into socket 212 after overmolding the recoil pad 200 onto the insert 208. In the present embodiment being described, passageway 220 is axially aligned with a corresponding elongated passageway 221 formed in buttstock 54 located proximate to a bottom surface 110 of the buttstock that receives swivel stud screw 140. Socket 212 is therefore axially aligned with both passageway 220 in pad 200 and passageway 221 in buttstock 54 being disposed between these two passageways.

Socket 212 may be formed with interior walls which are configured to engage and prevent nut 201 from rotating relative to the mounting insert 208 when stud screw 140 is threaded into the nut during the recoil pad 200 mounting process. In one embodiment, the walls therefore may be hex shaped to complement the shape of hex nut 201. Other possible embodiments contemplated may comprise using a four-sided flat nut (with square sides in top plan view) and a mating socket 212 having four complementary rectilinear walls configured to engage and prevent rotation of the nut. Accordingly, the invention is not limited to any particular shape of nut or socket. Numerous variations are possible.

To accommodate mounting swivel stud screw 140, an angle-shaped cavity 205 may be formed in the bottom surface 110 of buttstock 54. In one embodiment, cavity 205 may be generally V-shaped in side elevation view. Head 144 of stud screw 140 is at least partially received in cavity 205, and in one embodiment a portion of the head may protrude outwards beyond the cavity. In other embodiments, head 144 may be substantially flush with bottom surface 110 of buttstock 54. Cavity 205 includes a downward rear facing surface 204 and adjoining downward front facing seating surface 206 configured to engage the underside of stud screw head 144 as best shown in FIG. 15. Surface 206 may be substantially planar and oriented perpendicular to shaft 142 of stud screw 140. Passageway 221 in buttstock 54 communicates with cavity 205 for receiving shaft 142.

To mount the recoil pad 200 to buttstock 54, the pad is positioned rearward and axially aligned with the buttstock. Flange 209 is axially inserted into the open rear end 108 of buttstock 54 and engaged with recessed shoulder 211 (reference FIG. 15). The pad 200 and flange 209 are fully inserted until the flange is fully seated in should 211 thereby providing a relatively tight joint between the pad and buttock as shown. The threaded end 146 and shaft 142 of swivel stud screw 140 is then inserted through cavity 205 into passageway 221 until end 146 enters socket 212 in the recoil pad assembly 210. The screw 140 may be inserted through passageway 221 without rotation until nut 201 is engaged (assuming nut 201 has already been mounted in socket 212 of the pad mounting insert 208). Stud screw 140 is then rotated to threadably engage the nut 201 until the head 144 of the stud screw abuts seating surface 206 in the bottom surface 110 of the buttstock 54. Rotating screw 140 draws the recoil pad 200 axially forward and into tightened secure engagement with buttstock 54 to complete the recoil pad mounting process. The completed recoil pad and buttstock assembly is shown in FIGS. 14 and 15.

It will be appreciated that the foregoing recoil pad assembly mounting process and pad assembly construction may be used regardless of whether the recoil pad is mounted directly to a buttstock of rifle or to a buttstock module 70 using the modular system described herein. In addition, it should be recognized that the recoil pad assembly 200 may have many different and customized configurations; the invention not being limited to the non-limiting examples shown and described herein.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the an will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A modular buttstock system for a firearm, the system comprising:

a longitudinally-extending buttstock including a right sidewall, a left sidewall, a closed bottom connecting the right and left sidewalls, a front end, a rear end, and an internal rearwardly open cavity extending between the front and rear ends;

a buttstock module removably attached to the buttstock, the module including a longitudinally-extending upper comb portion positioned above the buttstock and a rear butt portion positioned at the rear end of the buttstock;

the buttstock module further including a forwardly projecting rear mounting flange inserted into the rearwardly open cavity of the buttstock;

a fastening mechanism removably securing the buttstock module to the buttstock;

an open top formed in the buttstock; and the buttstock includes a longitudinally-extending horizontal partition wall recessed within the open top, the partition wall being slidably engaged by a laterally spaced apart pair of downwardly projecting longitudinal side mounting flanges formed on the buttstock module.

2. The system of claim 1, wherein the buttstock module includes a laterally spaced apart pair of downwardly projecting longitudinal side mounting flanges inserted into the open top of the buttstock.

3. The system of claim 2, wherein the side mounting flanges are laterally inset from longitudinal side edges on the comb portion of the buttstock module to flushly mount the comb portion to the top of the buttstock.

4. The system of claim 1, wherein the rear mounting flange is laterally inset from vertical forward edges on the butt portion of the buttstock module to flushly mount the butt portion to the rear end of the buttstock.

5. The system of claim 1, further comprising:

a rearwardly open socket formed in the buttstock proximate to the front end; and a forwardly projecting front mounting flange slidably inserted into the socket for securing a front end of the buttstock module to the buttstock.

6. The system of claim 5, wherein the front mounting flange is inset from a front edge on the comb portion of the buttstock module to flushly mount the comb portion to the front end of the buttstock.

7. The system of claim 1, wherein the fastening mechanism includes a threaded fastener engageable with the buttstock module and buttstock.

8. The system of claim 7, wherein the fastener is a swivel stud screw.

9. The system of claim 1, wherein the buttstock is formed of a synthetic material.

10. The system of claim 1, wherein the buttstock module is formed of a synthetic material.

11. The system of claim 1, wherein the butt portion of the buttstock module has a first length, and further comprising a second buttstock module the same as the buttstock module but instead having a butt portion with a second length different than the first length.

12. The system of claim 1, wherein the comb portion of the buttstock module has a first height, and further comprising a second buttstock module the same as the buttstock module but instead having a comb portion with a second height different than the first height.

13. The system of claim 1, wherein the rear butt portion of the buttstock module has a forward edge that has a complementary shape to a mating rear edge of the buttstock to form an even and flush interface therebetween.

14. The system of claim 1, wherein the buttstock is contiguous with and formed as part of a unitary monolithic stock including a fore-end.

15. The system of claim 1, wherein the buttstock is cantilevered an extends rearward from a grip of the firearm.

16. A modular buttstock system for a firearm, the system comprising:

a longitudinally-extending buttstock including a front end having a rearwardly open socket, a rear end, and an upwardly open channel extending between the front and rear ends;

a buttstock module removably attached to the buttstock, the module including a longitudinally-extending upper comb portion positioned above the buttstock and a rear butt portion positioned at the rear end of the buttstock;

the buttstock module further including a downwardly projecting longitudinally-extending side mounting flange inserted into the open channel and a forwardly projecting front mounting flange inserted into the socket;

wherein the buttstock module encloses the buttstock when mounted on the firearm;

wherein the buttstock further includes an internal rearwardly open cavity extending between the front and rear ends;

wherein the upwardly open channel of the buttstock is separated from the open cavity by a horizontal partition wall recessed below longitudinally-extending to edges of the buttstock; and a mounting block formed integrally with the partition wall and including a rearwardly open bore configured to receive a shank of a threaded fastener at least partially therein for securing the buttstock module to the buttstock.

17. The system of claim 16, wherein the buttstock module includes a laterally spaced apart pair of downwardly projecting side mounting flanges inserted into the open channel of the buttstock.

18. The system of claim 17, wherein the pair of side mounting flanges of the buttstock module engage a laterally spaced apart pair of longitudinally-extending stub walls formed adjacent the open channel on the buttstock.

19. The system of claim 18, wherein the pairs of side mounting flanges and stub walls each gradually converge from the rear end of the buttstock moving towards the front end of the buttstock to form a wedging action for securing the buttstock module to the buttstock.

20. The system of claim 16, wherein the rearwardly open socket of the buttstock is located higher than a pair of longitudinally-extending top edges on the buttstock extending from the front end towards the rear end of the buttstock.

21. The system of claim 16, wherein the buttstock further includes a right sidewall, a left sidewall, a closed bottom connecting the right and left sidewalls.

22. The system of claim 16, further comprising a receptacle in the mounting block having an open top that penetrates the partition wall for insertion of a fastening element configured to engage the threaded fastener.

23. The system of claim 16, further comprising a swivel stud screw inserted through a bottom of the buttstock and engaging a threaded nut disposed in the buttstock module for securing the buttstock module to the buttstock.

24. The system of claim 16, wherein the rear butt portion of the buttstock module has a forward edge that has a complementary shape to a mating rear edge of the buttstock to form an even and flush interface therebetween.

25. A modular buttstock module system for a firearm, the system comprising:

a longitudinally-extending buttstock including a front end having a rearwardly open socket and an open rear end;

a buttstock module removably attached to the buttstock, the buttstock module including a longitudinally extending upper comb portion positioned above the buttstock and a rear butt portion positioned at the rear end of the buttstock;

the buttstock module further including a forward projecting rear mounting flange inserted into the open rear end of the buttstock and a forwardly projecting front mounting flange inserted into the socket;

wherein the buttstock module encloses the buttstock when mounted on the firearm;

wherein the buttstock module includes a laterally spaced apart pair of downwardly projecting side mounting flanges inserted into an upwardly open channel of the buttstock;

wherein the pair of mounting flanges of the buttstock module engage a laterally spaced apart pair of longitudinally-extending stub walls formed adjacent the open channel on the buttstock; and wherein the pair of side mounting flanges and stub walls each gradually converge from the rear end of the buttstock moving towards the front end of the buttstock to form a wedging action for securing the buttstock module to the buttstock.

26. The system of claim 25, further comprising a fastening mechanism for securing the buttstock module to the buttstock.

27. The system of claim 25, wherein the fastening mechanism includes a threaded fastener.

28. The system of claim 25, further comprising an internal rearwardly open cavity extending between the front and rear ends of the buttstock which forms the open rear end of the buttstock.

29. A modular buttstock system for a firearm, the system comprising:

a longitudinally-extending buttstock including a front end having a rearwardly open socket, an open rear end, and an upwardly open channel extending between the front and rear ends;

a buttstock module removably attached to the buttstock, the buttstock module including a longitudinally extending upper comb portion positioned above the buttstock and a rear butt portion positioned at the rear end of the buttstock;

the buttstock module further including a forwardly projecting rear mounting flange inserted into the open rear end of the buttstock, and a forwardly projecting front mounting flange inserted into the socket;

wherein the buttstock module encloses the buttstock when mounted on the firearm;

wherein the buttstock module includes a laterally spaced apart pair of downwardly projecting side mounting flanges inserted into the open channel of the buttstock; and wherein the pair of side mounting flanges are contiguous with the front mounting flange in construction.

30. The system of claim 29, wherein the side mounting flanges are laterally inset below longitudinally-extending side edges of the comb portion of the buttstock module to form a smooth contour with opposing right and left sidewalls of the buttstock.

31. The system of claim 29, further comprising a fastening mechanism for securing the buttstock module to the buttstock.

32. The system of claim 29, wherein the fastening mechanism includes a threaded fastener.

33. The system of claim 29, further comprising an internal rearwardly open cavity extending between the front and rear ends of the buttstock which forms the open rear end of the buttstock.

34. The system of claim 29, wherein the buttstock module is funned of synthetic material.

35. A method for assembling a buttstock module to a buttstock of a firearm, the method comprising:

providing a longitudinally-extending buttstock including a front end and an open rear end;

providing a buttstock module including a longitudinally-extending upper comb portion and a downwardly extending rear butt portion; and axially inserting a forwardly projecting rear mounting flange on the buttstock module into the open rear end of the buttstock;

wherein the comb portion of the buttstock is positioned above the buttstock and the rear portion of the buttstock module is positioned at the rear end of the buttstock;

providing the buttstock module with a laterally spaced apart pair of downwardly projecting side mounting flanges inserted into an upwardly open channel of the buttstock;

wherein the pair of mounting flanges of the buttstock module engage a laterally spaced apart pair of longitudinally-extending stub walls formed adjacent the open channel on the buttstock; and configuring the pair of side mounting flanges and stub walls such that the stub walls gradually converge from the rear end of the buttstock moving towards the front end of the buttstock to form a wedging action for securing the buttstock module to the buttstock.

36. The method of claim 35, further comprising inserting a pair of downwardly projecting longitudinal side mounting flanges into an upwardly open channel formed in a top of the buttstock.

37. The method of claim 35, further comprising axially sliding the side mounting flanges through the open channel from the rear end to the front end of the buttstock.

38. The method of claim 37, wherein the side mounting flanges are axially slid at least partially through the open channel before the rear mounting flange of the buttstock module is axially inserted into the open rear end of the buttstock.

39. The method of claim 37, wherein the pair of side mounting flanges of the buttstock module slidably engage a laterally spaced apart pair of longitudinally-extending stub walls formed adjacent the open channel on the buttstock.

40. The method of claim 35, further comprising axially inserting a forwardly projecting front mounting flange on the buttstock module into a rearwardly open socket formed in the buttstock.

41. The method of claim 35, further comprising inserting a threaded fastener through the buttstock module to threadably engage the buttstock to secure the buttstock module to the buttstock.

42. The method of claim 35, further comprising inserting a threaded fastener through the buttstock to threadably engage the buttstock module to secure the buttstock module to the buttstock.

43. The method of claim 35, wherein the buttstock includes an internal rearwardly open cavity extending between the front and rear ends that forms the open rear end of the buttstock, the rear mounting flange of the buttstock module being inserted at least partially into the cavity.

* * * * *